United States Patent [19]

Eager et al.

[11] Patent Number: 4,740,037

[45] Date of Patent: Apr. 26, 1988

[54] CONTINUOUS MINING MACHINE

[75] Inventors: Donald T. Eager, Kanahooka; George H. Keene, Woonona; Robert A. Newman, Bulli; Donald A. Kelly, Kanahooka; Norman B. Mason, Farmborough Heights; Charles R. Deamer, Church Point, all of Australia

[73] Assignee: Kembla Coal & Coke Pty. Limited, Wollongong, Australia

[21] Appl. No.: 763,137

[22] PCT Filed: Jul. 26, 1984

[86] PCT No.: PCT/AU84/00146

§ 371 Date: Mar. 11, 1985

§ 102(e) Date: Mar. 11, 1985

[87] PCT Pub. No.: WO85/00636

PCT Pub. Date: Feb. 14, 1985

[30] Foreign Application Priority Data

Jul. 27, 1983 [AU] Australia ..... PG0522

[51] Int. Cl.[4] ..... E21C 29/26; E21D 23/00

[52] U.S. Cl. ..... 299/45; 299/33; 299/54

[58] Field of Search ..... 299/33, 11, 31, 42, 299/45, 54, 67, 73, 75

[56] References Cited

U.S. PATENT DOCUMENTS

| | | | |
|---|---|---|---|
| 2,920,879 | 1/1960 | Driehaus | 299/73 |
| 3,813,126 | 5/1974 | Rogne, Jr. et al. | 299/33 |
| 3,827,754 | 8/1974 | Gilley | 299/31 X |
| 3,922,016 | 11/1975 | Tyslauk et al. | 299/33 X |
| 4,131,317 | 12/1978 | Jamison et al. | 299/31 |
| 4,199,193 | 4/1980 | Damron et al. | 299/11 X |
| 4,226,476 | 10/1980 | Fairchild et al. | 299/31 |
| 4,297,057 | 10/1981 | O'Neil | 299/33 X |
| 4,312,540 | 1/1982 | Thompson | 299/11 |

*Primary Examiner*—James A. Leppink
*Assistant Examiner*—David J. Bagnell
*Attorney, Agent, or Firm*—Cushman, Darby & Cushman

[57] ABSTRACT

A continuous mining machine includes a main frame mounted on tracks for mobility, a cutter head mounted on a subframe which is adapted to be moved toward and away from the front of the main frame, a conveyor to collect mined material and convey it to the rear of the main frame, and a roof bolter supported on the main frame adjacent the front thereof, whereby, as the subframe is moved away from the front of the main frame and the cutter head mounted thereon operates to cut material to be mined, thereof bolter is simultaneously operated to perform roof bolting operations close to the face of the mine.

9 Claims, 6 Drawing Sheets

CONTINUOUS MINING MACHINE

TECHNICAL FIELD

This invention relates to continuous mining machines.

BACKGROUND ART

With reference to FIG. 1 of the drawings, the most common method of cutting coal and supporting the roof used in Australian coal mines for roadway driveage uses timber props 10 set at each side of the roadway 11 beneath or adjacent to steel straps, wooden bars or similar devices 12 held to the roof by roof bolts 13. The straps or bars 12, are usually supplied cut to the required length to suit the roadway width and usually with predrilled holes at the desired roof bolt positions. Props 10 are usually supplied over-size, cut to length on site and installed by hand using wooden wedges to tighten them in position. Roof bolts 13 are steel rods 14 of the required length supplied with an anchoring device 15 (most commonly a resin type of glue) to fix one end in the rock, and a threaded outer end to take a nut 17 and steel washer 16. Their action is to clamp the layers of roof strata together to form a strong beam and/or to suspend layers of broken strata from more stable higher layers.

To install a roof bolt, a small hole (usually of the order of 27 mm diameter) is drilled into the rock to the length of the bolt. A cartridge containing a two part resin mix is then inserted into the hole and pushed to the end using the bolt itself. The bolt is then spun for a few seconds. This has the effect of breaking-up the cartridge and mixing the resin parts. Because of the fast-setting nature of the resin, the nut can be tightened almost immediately to bear against the roof strap, bar, etc., and a degree of tension is thus applied to the bolt. The same machine is normally used to drill the hole, install the bolt and tighten the nut using various adaptors fitted to the chuck. During installation of the first two bolts the strap, bar, etc., is normally held in position by two hydraulic jacks attached to the mining machine. The drilling machines are commonly hand held machines supported on an extendable leg, but can be attached to the mining machine.

It should be noted that there are wide variations in the system described above in number, type, and spacing of supports and bolts, types of bolt anchoring systems, and angle at which bolts are installed. These variations depend on a number of factors, notably surrounding rock types and strengths, roadway heights and widths, and stress conditions. However, the basic system is the same in the majority of cases.

The machine which actually cut the coal, the continuous miners, come in a variety of makes and models, but are all basically the same in principle. The main frame which supports the working parts and contains motors, hydraulic pumps, tanks, controls, etc., is mounted on a crawler track assembly for mobility. At the top of the front of the machine is mounted the cutting head which has rotating drums and/or chains fitted with cutter picks to cut the coal. In the current range of machines the head is usually referred to as fixed which means it cuts a set width although it can be raised and lowered to cut the desired height. The cut coal falls to the floor where it is picked up by a loader apron fitted with some type of gathering device which guides the coal into the centre of the machine. From here the coal is collected by a scraper conveyor which runs through the centre of the machine to a luffing and slewing jib which enables the coal to be loaded into mobile vehicles (shuttle cars) behind the miner for transportation to the conveyor belt system.

Because the machiens can only cut approximately their own width at one time it is necessary to move them around to cut the full width required. Also, in order to cut forward the whole machine has to tram into the face. It therefore follows that while coal cutting operations are in progress the whole machine is almost continuously moving in a confined area. This makes it very hazardous, if not impossible, to work alongside the machine while it is cutting and it is in this confined area that the roof support operations have to be carried out. As a consequence the whole process becomes cyclic whereby a certain amount of coal is cut and mining operations then cease while roof support is carried out.

The need for the whole machine to move while cutting also precludes the use of miner mounted drill rigs and temporary supports during the cutting time.

The delay caused to coal cutting by this cyclical nature of operations varies according to the degree of support required in the given conditions, but is commonly of the order of 30% of available time.

It is therefore an object of the present invention to provide a continuous mining machine which minimizes the delay to coal cutting caused by positioning of the roof supports, and such that the mining process will become more continuous.

Because of the wide range of variations in seam thickness, strata and stress conditions (and hence support requirements) and mining methods, it is impractical to develop one machine to cover all requirements. The aim of the present invention is to cover the most common situations and mines with additional or less requirements being treated as special cases requiring modifications to the basic machine, or variations in the method of use which may affect its ability to mine continuously.

These basic parameters for the machine are as follows:

(a) Ability to cut and support continuously in seams up to 3.0 m thick with supports 1 m apart, with the time taken to install supports being 5 mins. This leads to a necessary maximum cutting rate of 4.2 tonnes/min for a 5.0 m wide roadway (coal density in the solid of 1.4 tonnes/$m^3$).

(b) Increase production and rate of advance in development headings.

(c) Ability to install up to 4 roof bolts simultaneously. Any requirements for less would not present a problem as rigs could be omitted. Requirements for more would be special cases where additional bolts would have to be installed either behind the machine or by delaying production. Even in the latter case improved production would be expected in comparison with current methods.

(d) Capability of operation in a 4 m wide roadway, but with the ability to cut a variety of greater widths if required.

(e) Ability to roofbolt within 1 m of the face for at least some of the bolts which may require some flexibility in roofbolter mountings.

(f) Incorporation of a minimum working height of 1.5 m, although 2.0 m would be acceptable for most cases.

(g) Provision of a maximum machine width of 2.4 m and length of around 12 m; articulation to be used if a greater length is required.

(h) Design for a maximum weight of 50 tonnes. Any requirements for separation to be as simple as possible, and any parts removed to be easily handled; articulation may be an advantage here provided both halves are able to tram individually. Also to aim for a maximum floor loading of 165 kPa.

(i) Design the machine for ease of access to all parts for maintenance purposes.

More importantly, and in accordance with the basic objective of the present invention, it is required that the roof bolters be an integral part of the machine.

The mining methods performed with existing equipment, involve either providing a machine essentially in two parts, whereby a stable platform is provided for roof support operations by one part while the other continues to cut coal, or alternatively two separate machines able to work in the same area, removing roof support operations from the face area while production is in progress. The latter operation can be done by cutting coal for a period at one face and then moving to another face while the first is supported. Alternatively, temporary supports can be installed to hold the roof and permanent supports installed a distance behind the cutting operations.

The moving of equipment to another face is only practical if the distance advanced before moving is reasonably great. There are few mines in Australia where roof conditions are suited to this system. The time spent tramming from place to place also introduces an additional element of non-productive time. The option of setting temporary supports has been attempted in several mines. The use of relatively light hand-set supports is generally inadequate to control the roof in places where roof bolts are ultimately required. This led to the development of large frame type supports across the roadway which were self-advancing in a manner similar to longwall chocks. Such units, however, suffer from two major disadvantages. Firstly, the self-advancing action of the supports necessitates continuously loading and unloading the roof strata which causes it to break up, and in itself can lead to poor roof conditions. Secondly, the frame structure has to be large and is therefore unable to negotiate a bend of suitably small radius in the roadway, that is, it is only suited to single heading development. A further possible disadvantage is that although roof support operations are removed from the immediate face area they still have to be carried out in the initial coal transport area. Thus, there is still a potential for the operations to interfere with production and become hazardous, particularly if shuttle cars are used.

For the above reasons, it is clear that such a method is not practical for most Australian mines.

It is therefore intended, with the machine of the present invention, to follow the alternative procedure of providing a single machine to allow for roof support operations as well as continuous cutting of the coal. Machines presently available incorporating provision to perform both functions are the Joy 1CM and 6CM as supplied by Joy Manufacturing Company Pty. Limited. These machines have a cutting head similar to present continuous miners but mounted on a turntable with fore and aft slides fixed to the body of the machine. After tramming the machine up to the face the head can be sumped in using the slides, and by raising and lowering the cutting head and slewing on the turntable, the full roadway profile can be cut for a certain increment of advance while the body of the machine remains stationary. While the principle of being able to work alongside the machine whilst cutting is satisfied, and a stable bolting platform could be provided, it has been found that the length of head required to reach the full profile of the roadway meant that the bolts could, at best, only be installed up to 2.5 to 3 m from the face. Such unsupported spans may be acceptable in some mines but there are many cases where this would lead to serious loss of roof control.

The same problem exists with roadheader styles, of machines such as supplied by Voest Alpine (Australia) Pty. Limited (VOEST-ALPINE AM75). With such a machine the long arm necessary to cut the desired roadway profile requires that any bolting system be sited outside the arc, which the arm must cover, in order to be able to bolt and cut at the same time. Additionally, many of the roadheader style machines do not have a head which can sump forward, the sumping action being carried out by tramming the whole machine forward. This precludes any roof support functions being carried out from the frame of the machine at least during the sumping action.

Consideration has therefore been given to types of machines that either cut the full profile of the roadway in a planing or milling action with a short depth of cut, or need a relatively small cutting head mounted on a device which could be manoeuvred in a vertical plane parallel to the face to profile the full size required.

Such a style is the borer miner as developed by Goodman and Marietta commonly known as the Goodman Borer Miner. Such machines cut a rectangular profile with rounded corners and, to some extent, rounded sides in one pass. However, whilst such machines cut a uniformly sized and stable profile, they suffer from a number of disadvantages. The machines are notoriously difficult to steer satisfactorily in the vertical plane and cannot negotiate a very sharp turn in the horizontal plane, whilst they are unable to cope with large variations in seam height. Because of the mass of machine required to thrust the head into the coal to cut the full profile in one pass, such machines are also not suited for the attachment of roof support equipment close to the face.

A similar style of machine to the Goodman Borer, is known as the Dosco In Seam Miner. This machine cuts an oval profile roadway using an endless chain type of cutter around the periphery of the machine. The unit is not track mounted but rests on the floor, and is moved forward by hydraulic pusher rams reacting against hydraulic chocks set between roof and floor behind the machine. This configuration provides the ability to carry out roof support operations very close to the face. However, the cutting height is limited to around 1.8 m which is not satisfactory for most Australian mines. Also, being floor mounted, the machine is unable to negotiate sharp horizontal curves and is essentially a single entry machine.

Two other styles of machines with a relatively small cutting head and moveable in a vertical plane parallel to the face, are the Eickhoff ESA60-L and the Westfalia VMO8.

The Eickhoff ESA60-L consists of a small ranging arm shearer mounted on a short section of armoured conveyor. The shearer can be moved across the conveyor to be able to cut the desired roadway width, and the arm can be raised or lowered to cut the desired height. At the end of machine travel the arm is swung round in a vertical plane, thus cutting a semi-circular profile on the roadway sides. The conveyor section rests on the floor and forward advance is obtained by the use of hydraulic rams similar to the Dosco In-Seam Miner. While this style of machine could be track-mounted to obtain better manoeuverability, and also allows roof supports to be set close to the face, it too suffers from a number of disadvantages. The cutting drum cannot be sumped in directly and the head must be angled across the face so the sumping action is carried out across the face width. The advance of the machine thereby becomes a shuffling action where only one side is advanced at a time. The large radius curved sides, while having some support benefit, are not amenable to setting timber and require a very wide effective roadway in order to obtain sufficient width of flat floor for most purposes, especially in thick seams.

The Westfalia VMO8 is a small cutting head style of machine which has been developed. This heading machine is a floor mounted machine with a cutter head, somewhat similar to that on a continuous miner, carried on an armoured conveyor. The cutting style of this machine has the advantages of allowing supports to be set close to the face, cutting a straight-sided roadway amenable to minimizing width and the use of timber supports, and producing a concave face in the vertical plane thereby reducing the unsupported roof span ahead of the supports.

The cutting head of the Westfalia machine consists of two cylindrical drums attached to each end of a T-shaped arm able to range vertically within limits governed by the maximum cutting height required. The drums are constructed in the form of two spoked wheels connected by a series of six blades around the periphery. Cutter picks are attached on the outer circumference of the wheels, on the outside surfaces of the cylinder sides and on the outer edges of the blades, so that the drums can cut in any direction. The direction of rotation is such that the top of each cutting drum moves towards the face, and in this way the blades supply a loading action for the cut coal onto the conveyor. The machine is designed to be able to cut up to 125 mm below the floor.

The drive motor for the cutter head is 90 kW hydraulic motor mounted on the axis of rotation of the ranging arm, driving through a chain drive onto a common shaft for the cutter drums. The cutter drums are 0.9 m diameter and the peripheral speed is variable between 0 and 5 m/sec (rotation approximately 0 to 106 rpm).

The vertical ranging action of the head is controlled by a hydraulic cylinder mounted between the cross-member of the T-shaped arm and the head support frame.

The head support frame is mounted on a trapped rail system which forms part of the face conveyor; the head is thus free to travel in a direction parallel to the face. Travel in this direction is controlled by a chain driven by a hydraulic motor mounted on one end of the face conveyor, with adjustable speed from 0 to 13 m/min.

The conveyor system of the Westfalia machine is a scraper chain in the form of a T, the cross-member of which forms the face conveyor and also carries the trap rail system for the head support frame. The scraper chains are single strand with flights cantilevered out to one side, and are trapped in a groove on the rear side of the face conveyor. The face conveyor also has a ramp plate on the leading edge to enable pickup of coal not loaded by the action of the cutter drums.

Separate scraper chains operate on each side of the machine and at the throat (usually, but not necessarily, in the centre of the machine) are guided through 90° and run up the delivery section, the flights interspacing in the same fashion as the teeth of a zip fastener. The conveyor chains are hydraulically driven on a common shaft from the delivery end of the system. Depending on the chain speed the conveyor capacity is 200 to 250 tonnes/hour.

On the outer ends of the cross-member of the T-Conveyor are hinged skids, operated by hydraulic cylinders, which are able to bear against the rib sides and so prevent the body of the machine being pushed sideways.

Forward thrust is applied to the cutter head by two large hydraulic rams mounted to the rear of the face conveyor, and reacting against hydraulic chocks set between roof and floor in the roadway behind the machine. As well as supplying a reaction point for the rams, these chocks also have a temporary roof support function, the permanent supports being set behind them.

The hydraulic chocks are self-advancing similar to chocks used on longwall faces. They can also be used to drag forward the power packs and main conveyor as the machine advances.

Power is supplied from 2×90 kW power packs, one to supply the cutter motor, the second for the conveyor drive, hydraulic chocks and hydraulic rams.

To minimize dust in the working area, 2×500 mm diameter exhaust ducts are permanently mounted from the hydraulic chocks with a flexible section leading back to the main duct or brattice line.

At the start of a cutting cycle with the Westfalia machine the head is at floor level against the face. To sump, the machine is pushed forward by the hydraulic rams, and both cutting drums cut into the face in the direction of face advance. The depth of sump is approximately 0.3 m and is governed by the distance from the front edge of the cutting drums to the cross-member of the T-shaped ranging arm.

On completion of sumping, the head is pulled across the full width of the heading. Initially, cutting is carried out by the outer edge of the leading drum and the inner edge of the trailing drum until the core of coal formed between the drums is removed. From this point on only the leading drum is cutting. After cutting the full width the head is raised to the next level and traversed back across the width of the roadway. This process is repeated for another one or two passes, depending on the seam height, until the full cross-section has been cut. The head is then dropped back to floor level and a clean-up run is made across the face.

Finally, the machine is pushed forward again by the pusher rams to begin the cycle once more. The self-advancing supports may be moved forward at any convenient time during the number of cycles allowed by the full stroke of the pusher rams.

An alternative method with the Westfalia machine is to oscillate the cutting head during the sumping operation so that the core is removed in the sumping process thereby allowing a deeper sump, up to about 0.5 m. The remainder of the cycle will be carried out in the same way as before, but with a correspondingly larger depth of cut. This method enables more coal per machine traverse to be obtained, but the depth of sump possible will be dictated by the nature of the coal being cut and the power available.

Other cutting patterns could be used, the most suitable depending on the nature of the material being cut and the conditions at the face.

However, although the Westfalia works satisfactorily in principle and produces a good roadway, it suffers from a number of problems.

In one mine roof bolting was carried out behind the machine after a certain distance of advance had been achieved. Ultimately, a major fall occurred behind the machine, burying much of the equipment. It is considered that the major cause of the fall was the delay in installation of the roof bolts, and this was no doubt exacerbated by the cycling of the roof by the hydraulic chocks associated with the machine.

One major drawback of the Westfalia machine is the low production potential, which is only of the order of 1-2 tonnes/min., and its slow rate of advance.

In another mine a Westfalia machine was modified by mounting the hydraulic pusher rams on a Joy 6CM chassis.

Trials with the modified machine were successful in that the track frame was able to provide a sufficiently stable base for sumping the cutting head, and the roadway proved to be very tidy and stable. Mining conditions were also improved greatly over those existing in adjacent roadways. However the rate of advance of the machine was not satisfactory, and it has been withdrawn from service.

From a consideration of all the machines presently available it was apparent that a machine based on the principle of the Westfalia VMO8 has the greatest potential to satisfy the objectives, provided the problems therewith could be overcome and in particular provided a greater production rate can be attained. The main points in favour of a Westfalia style of machine are as follows:

(a) Permanent supports can be set close to the face, probably within 1 to 1.4 m.

(b) The machine would cut a straight rib and a roadway width which will be constant. This would lead to improved roadway stability and is amenable to setting timber supports, if required, close to the rib. It also provides the minimum roadway width for a given width of flat floor.

(c) The face would be cut with a concave shape from roof to floor, which reduces the effective span of unsupported roof in front of the machine.

(d) The cutting action is relatively gentle and in small increments which again aids roadway stability and can be advantageous in gassy seams.

(e) Much of the machine can be made up from items of already proven design.

(f) The style of machine has been trialled and was successful in principle.

DISCLOSURE OF THE INVENTION

The present invention therefore envisages a continuous mining machine, comprising a main frame mounted on tracks for mobility, a cutter head mounted on a subframe which is adapted to be moved toward and away from the front of said main frame, conveyor means to collect mined material and convey it to the rear of said main frame, and roof bolting means supported on said main frame toward the front thereof.

BRIEF DESCRIPTION OF THE DRAWINGS

One preferred embodiment of the invention will now be described with reference to the accompanying drawings; in which.

BEST MODE FOR CARRYING OUT THE INVENTION

Figure 1:
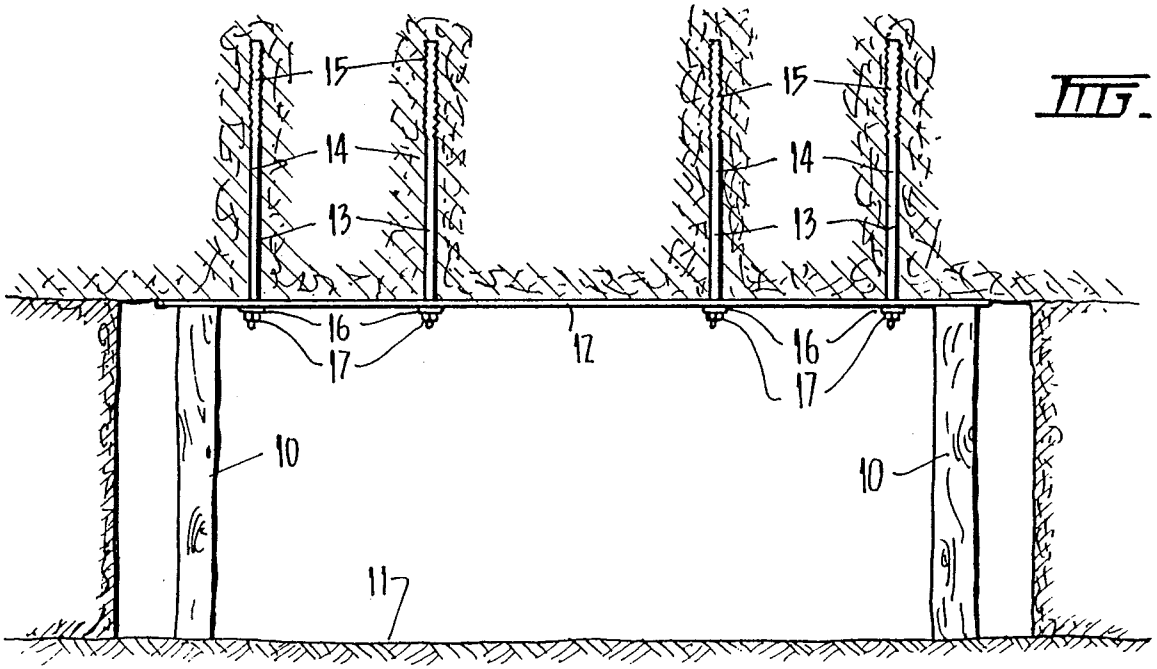
FIG. 1 is a sectional view of a mine roadway illustrating a commonly known technique for cutting coal and supporting the roof, as described previously.
Figure 2:
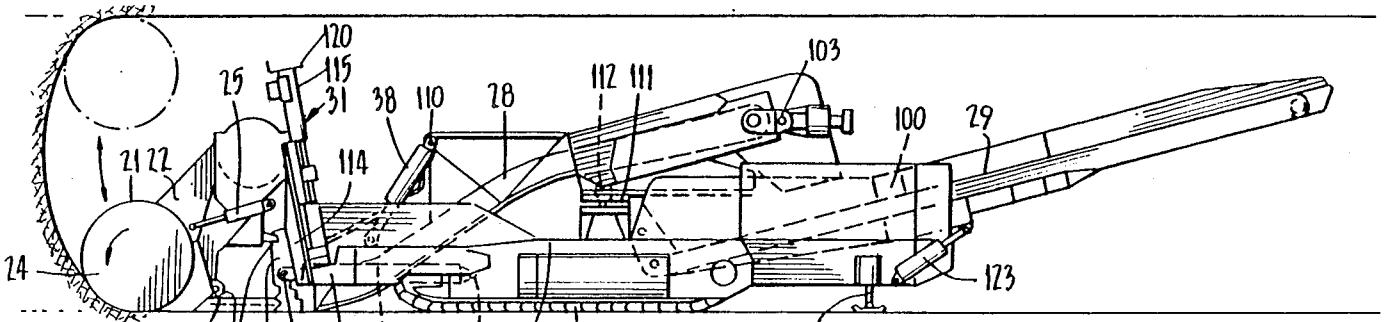
FIGS. 2 and 3 are two side elevation views of the general arrangement of the machine of this preferred embodiment of the invention showing the two head sumping positions.
Figure 3:
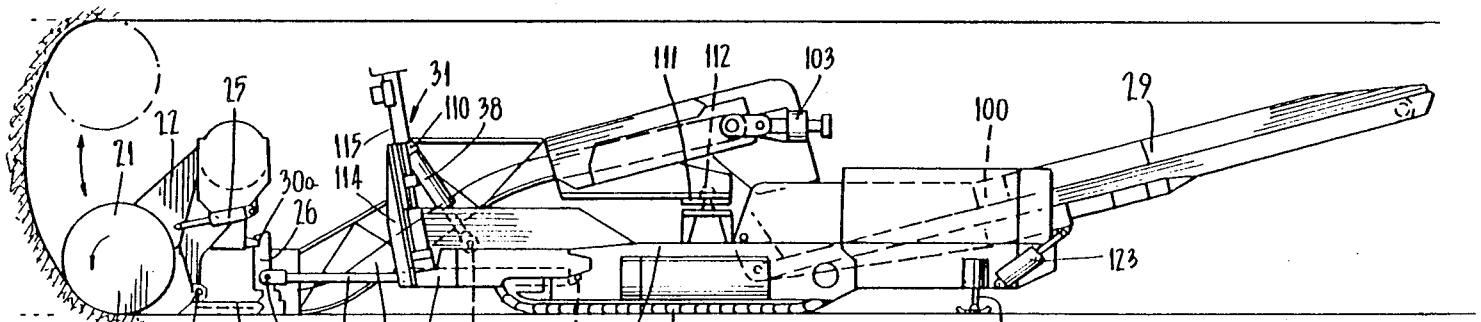

In basic design and principle of operation, the cutting head 21 mounted on a cutter head support frame 26 is the same as the Westfalia VMO8, having a cutter head 21 incorporating cutter drums 24, pivotable ranging arm 22, pivotable under the action of a head ranging ram 25 and cutter motor 23 which drives the shaft for the cutter drums via a multi-link chain drive extending through the ranging arm 22. Increased power is achieved by the use of a large motor (estimated to be of the order of 100 to 110 kW), and associated strengthening of supports and drive components. A maximum pick speed in the order of 1.2 m/sec is considered desirable in minimizing dust and reducing the risk of frictional ignitions of methane.

Another variation from the Westfalia VMO8 design relates to the overall width of the cutting head. As discussed hereinafter, the overall width of the face conveyor system may need to be easily reducible to facilitate turning away and retraction of the machine from the working face when necessary. This will result in being unable to extend the train rail system to extremities of the face conveyor. In order to be able to cut a sufficient distance beyond the width of the machine, the overall width of the cutter head may be extended and/or the width of the head support frame reduced. The extent to which this can be done is affected both by stability and strength considerations, and by the fact that the distance from the inside edge of one cutter drum to the outside edge of the other must be less than half the total roadway width, in order to be able to cut out the core between them.

The leading zipper conveyor 28 having a face section **28*a* of the Westfalia VMO8 has been retained in the basic design with certain additions. In order to be able to negotiate a turn with the machine, it is desirable to have the swivel or slew conveyor 29 at the rear. When the conveyor 29 is swivelled, there is a difference in length between the outer and inner sides of the curve. With the "zipper" type of conveyor 28, such a difference is not acceptable because the two chains would become unsynchronised, and the flights would foul and jam at the throat of the machine. Therefore, the machine has the two separate conveyors, 28 and 29. The front "zipper" type 28 loading onto the second type 29 in the centre of the tracked main frame 30. The second conveyor 29, being a centre strand type, is therefore able to swivel at 100 under the action of two rams, 101 and 102 one on either side of the swivel 100 and coupled between the main frame 30 and the tailing section of the slew conveyor 29. Hydraulic motors 103 at the trailing end of the zipper conveyor 28 serve to drive the two flights of that conveyor, whilst electric motors 104 on the trailing end of the slew conveyor serve to drive that conveyor. The slew conveyor 29 is also pivotally mounted in the main frame 30 so as to be capable of being tilted up and down about the pivot by means of a hydraulic ram 123 coupled between the main frame 30 and the conveyor 29**.

The front section of the machine comprising the zipper conveyor 28 with its face sections 28*a* and cutter head support frame 26 is mounted to the main frame 30 so as to be extended forwardly of the main frame 30 during cutting operations whilst the main frame 30 remains stationary, and because the front conveyor 28 would move forward with the cutting head while the rear 29 would remain stationary with the track frame 30, the two conveyors overlap by the maximum advance of the head relative to the track frame 30.

The face conveyor section 28*a* needs to be close to the full width of the roadway in order to ensure good clean-up and to avoid leaving coal in the ribs. However, in order to turn away, it is desirable to be able to reduce this overall width without reducing the reach of the cutting head 21. It is also necessary to be able to reduce this overall width in order to retract the machine for repairs and maintenance, or to move to another working place. It would be possible to make provision for this shortening by having bolt-on sections (not shown) on each end of the face conveyor 28*a*, although this would entail a major operation each time. It is therefore envisaged that the final section of each side of the face conveyor 28*a* be replaced by a short section containing another type of loading device, which can be readily retracted or folded up by the use of hydraulic cylinders. The type of device could be simply a dozer blade or small spinner disc (not shown).

Figure 4:
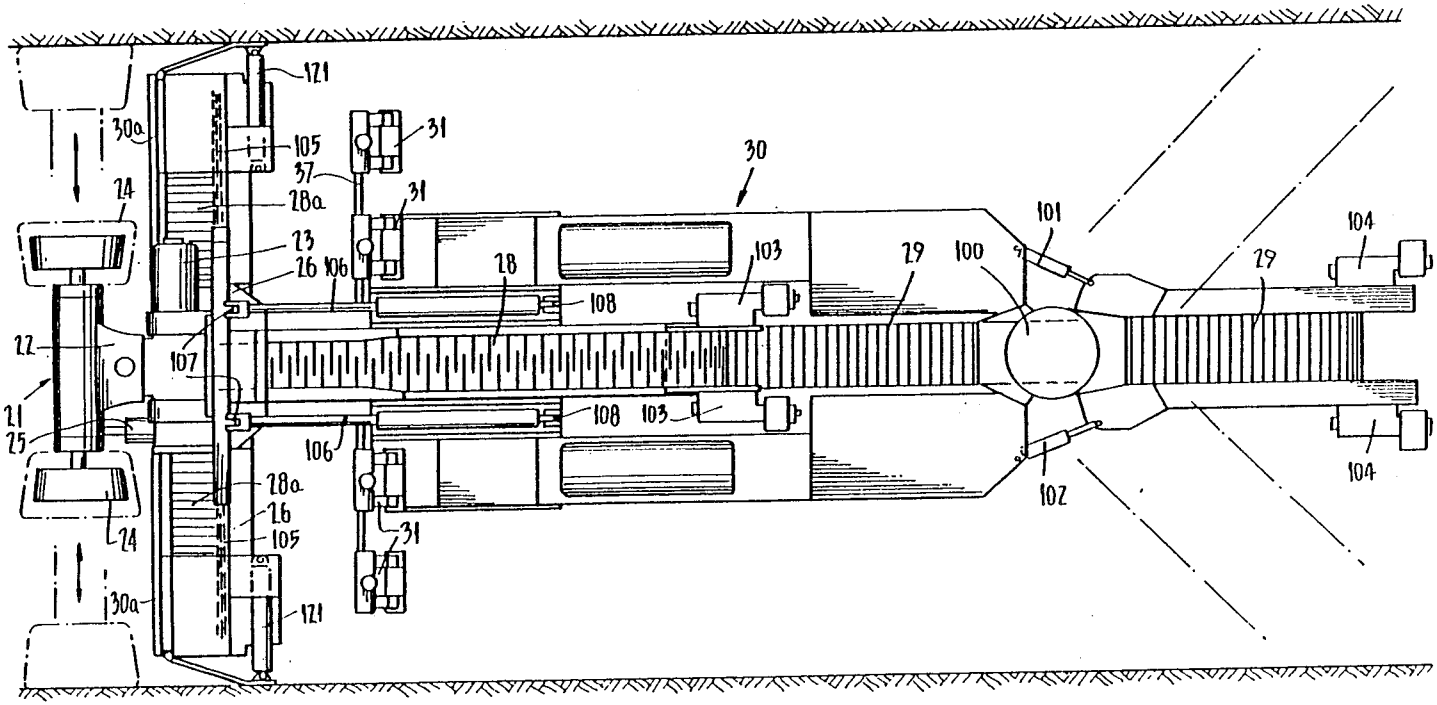
FIG. 4, is a plan view of the machine of FIG. 2 in the extended head position.

In order to minimize the number of joints, the centre section of the face conveyor 28*a* on which the cutting head 21 is mounted for movement, on upper and lower rails 30*a*, by a motor driven chain drive 105 (see FIG. 4), would be manufactured in one piece to the same width as main frame tracks 30*b*. The next section (on each side) would be bolted on, so that they could be removed for transport into and around the mine.

Figure 5:
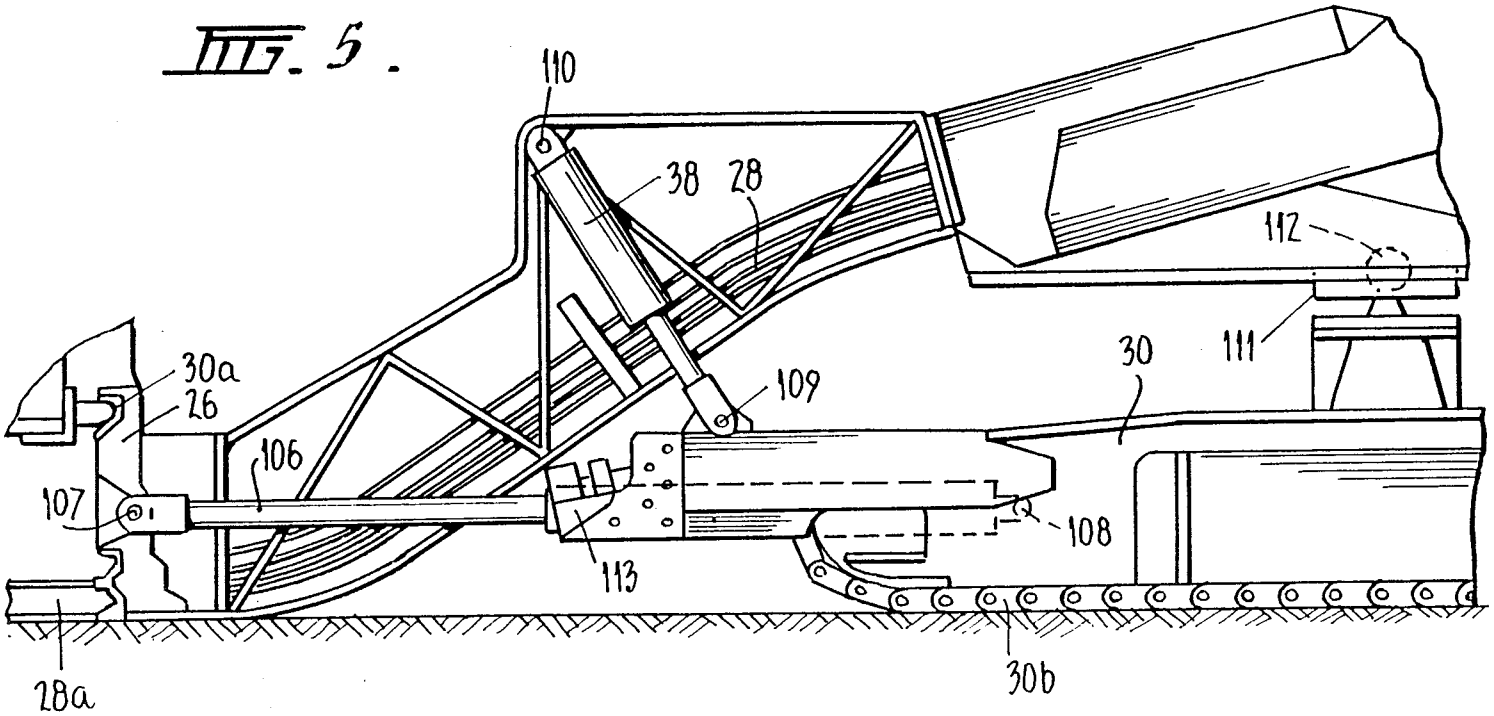
FIGS. 5 and 6 are enlarged side elevation views, with the roof bolters omitted for the sake of clarity, of a mechanism incorporated in the machine to enable the machine to negotiate changes in floor grade, traverse changes in floor horizon, and raise the front section for flitting.
Figure 6:
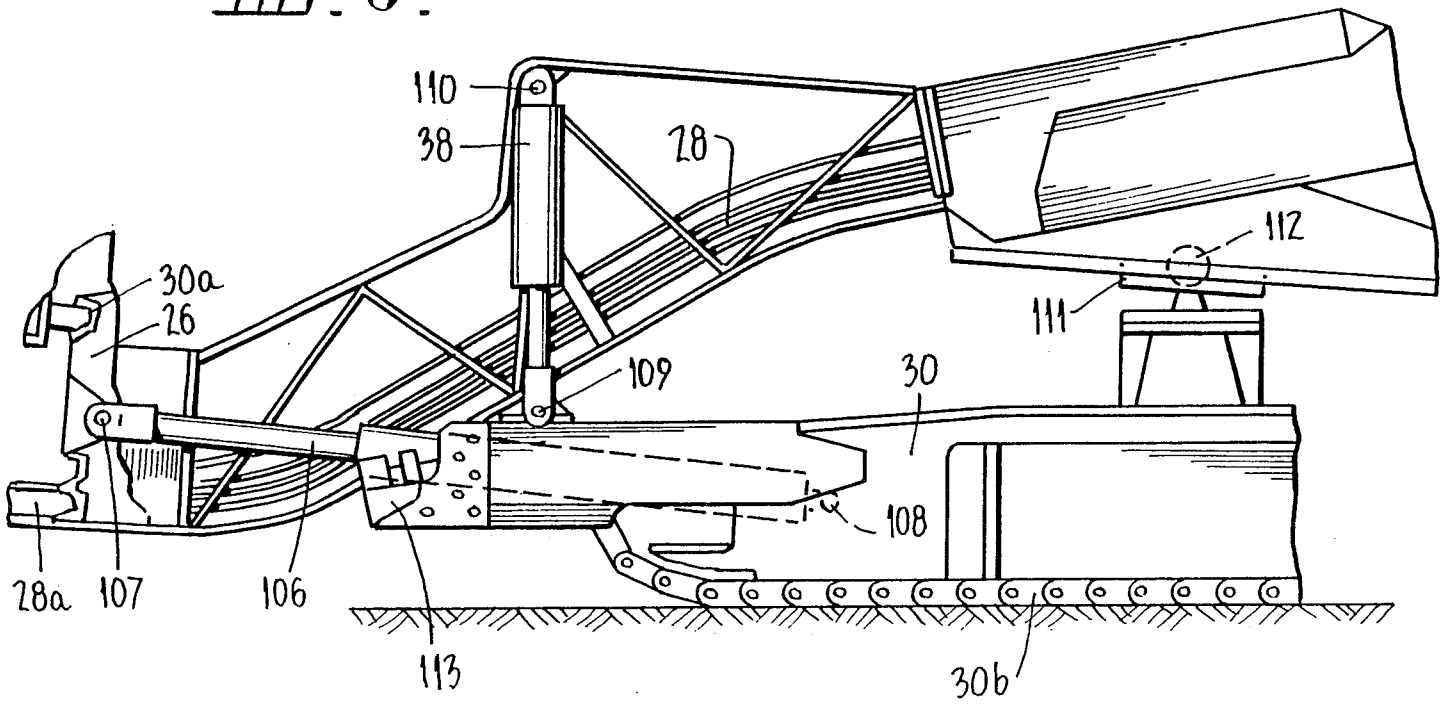

In the machine envisaged, all the parts so far described, with the exception of the rear conveyor 29, would be designed to be advanced a certain distance (e.g. 1 meter) while the main track frame 30 of the machine remains stationary. In order to do this, one proposal is that the conveyor section 28, with the cutting head 21, be mounted on the ends of two large hydraulic sumping rams 106. The cylinder pistons are pin-jointed at 107 onto the support frame 26 for the conveyor 28 and at 108 onto the main frame 30. Two smaller lift cylinders 38, pivotably mounted on either end (109 and 110), are provided to enable the face conveyor 28*a* and head 21 to be lifted off the ground, so that the machine can be retracted from the face and trammed to another site (see FIGS. 5 and 6). The trailing end of the frame for the conveyor 28 is slidably mounted at 111 to enable movement relative to the main frame 30 and is retained against separation by a ball joint 112 to allow for tilting of the conveyor when the face conveyor 28*a* and cutting head 21 are lifted off the ground.

In certain circumstances the sumping rams 106 may be very prone to damage by twisting from any high loads on the extremities of the face conveyor section, or from any uneven floor conditions. To overcome this the sumping rams 106 are pin-jointed at both ends, that is, at 107 and 108, with spherical bearings and therefore free to move relative to each other in the vertical plane. With this system, the sumping rams 106 do not carry any vertical loads. The cutter head 21 and front conveyor system 28 would be supported entirely on the floor, and would merely transmit horizontal thrust.

For stability, the sumping rams 106 would be mounted approximately along the centre line of the tracks 30*b* to the main frame 30.

The main track frame 30 is similar to the track frame of existing continuous miners, but with an extension 37 on each side of the front end to support the roof bolting machines 31. This is envisaged to be in the form of a ledge 113 with a front plate 141 for additional rigidity. The front plate 114 is angled to allow the bolting machines 31 to be angled forward up to 10°, thereby keeping the unsupported roof to a minimum. The extensions 37 need to be sufficiently rigid, not only to carry the weight of the bolters 31, but to provide the reaction to the thrust required for drilling.

The extensions 37, rigidly attached to the main frame 30, will provide a stable bolting platform allowing roof support operations to be carried out at the same time as coal cutting operations.

The tracks 30*b* are made as large as possible in order to obtain maximum stability and resistance to the thrust on the cutting head. The frame 30 should resist all the reacting forces likely to be encountered without movement.

Figure 7:
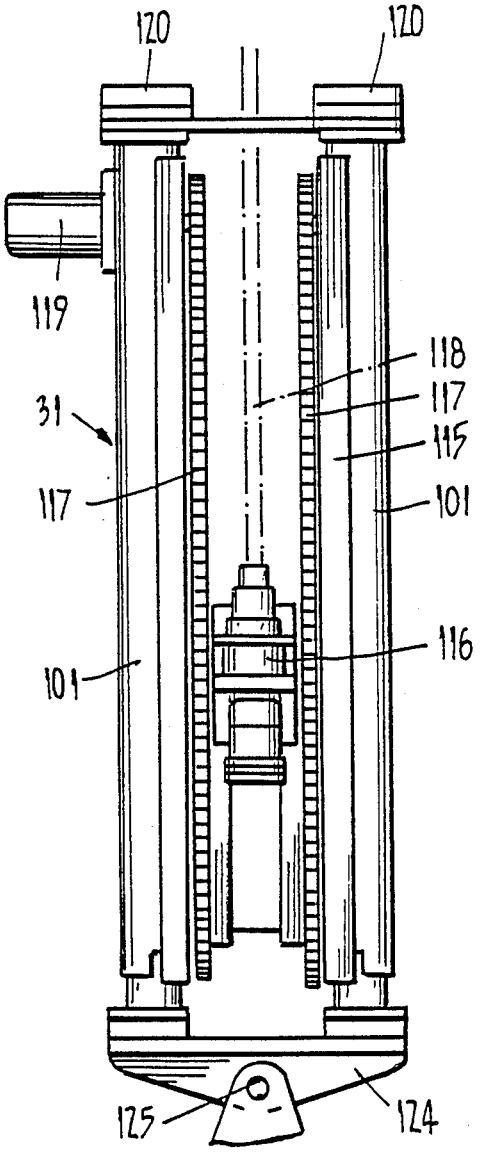
FIGS. 7 and 8 are enlarged side elevation views showing the details of the roof bolters as mounted on the machine of the preceding drawings.
Figure 8:
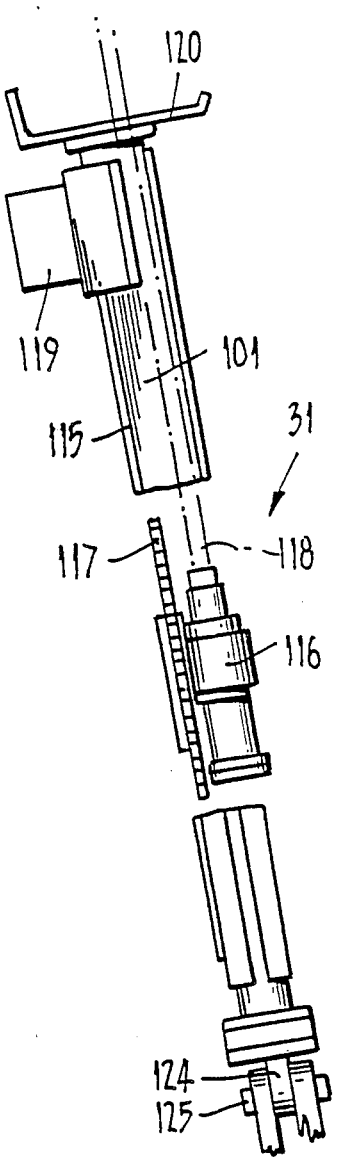

The roof bolters 31 may be of a conventional type, and either hydraulic or pneumatic depending on the preference of the user. In practice hydraulic rigs require complex equipment on the machine because of the necessity to provide adequate pump and oil reservoir capacity. Other types require only the mounting position to be provided. As shown in FIGS. 7 and 8 each roof bolter 31 comprises an upstanding frame 115 incorporating hydraulic rams 101 and within which a drilling machine 116 with drilling bit 118 is mounted for movement up and down the frame by a chain drive 117 driven by a hydraulic motor 119. The upper end of the frame 115 has a pair of support members 120 adapted to engage beneath the strap or bar which is to be bolted to the roof. If there is a requirement for angled bolts across the heading the bolters can be mounted on pivot joints 125 through yokes 124 on the bottoms of the frames 115 with the only drawback being that control of the bolter position by hydraulic cylinders (not shown) would become more complex.

As shown the basic machine of this preferred embodiment carries four roof bolters 31 for simultaneous operation. A further two bolters can be mounted (subject to the roadway width not being less than 5 m) although hydraulic capacity may be a drawback. In some situations, a shorter roof bolter or bolting rig could be mounted on a platform above the centre conveyor 28, to install short roof bolts.

When using hydraulic driven roof bolters 31, sufficient pump and oil reservoir capacity is necessary. Current hydraulic rigs require a supply of approximately 2.25 liter/second. Added to the four roof bolters would be the supply required to operate the various hydraulic motors and cylinders to give an overall total of the order of 20 liter/second. This order of magnitude of supply requires the provision of large or numerous pumps, large oil reservoir capacity and attention to heat dissipation. Considerable weight will be required on the main frame 31 to provide stability, in which case, all of this equipment would probably be mounted on or in the frame. If not, a power pack may be positioned near the face area with the hydraulic oil transmitted to the machine by a trailing hose system. The cutter head 21 may also be hydraulically driven and would have the additional advantage, that the only electric power required at the face would be for lighting. The power pack would be moved forward in a similar fashion to existing load centres and could be readily replaced in the event of breakdown.

Because the machine is designed for continuous operation, surge capacity should be provided behind the machine so that delays waiting for shuttle cars are not encountered. A special surge car may be provided, which may be track mounted, able to continually receive the output from the miner and transfer the load to a shuttle car in a very short time. This surge car could be attached to the rear of the machine and be pulled along as it advances, although it would be preferable that it be self-propelled and independently operated.

For optimum operation, it is envisaged that directional control be maintained by the use of a laser with a target mounted on the machine.

In order to improve stability of the machine it is probable that "stell jacks" 121 will be fitted on the outer ends of the face conveyor system to bear against the ribs.

If it is found necessary, floor jacks 122 may be installed under the rear of the main frame 30 as an aid to horizon control.

In order to deal with any dust problem in the area of the bolting machines, where men will be working close to the cutting head, a dust extractor (not shown) is provided in the form of a vent duct with intakes along its length attached to a small auxiliary fan, and mounted along the top of the face conveyor section 28*a*. This would exhaust into the return air or through a scrubber into the air stream out by the machine.

In operation, the machine is positioned at the face with the sumping rams 106 fully retracted, and both roof bolting and coal cutting operations commence simultaneously. The method of operation of the cutting head 21 will be the same as that for the Westfalia VMO8, with a relatively small sump followed by a combined trepanning and shearing operation until the first increment of advance has been fully profiled. The cutting head 21 and conveyor 28, 28*a* would then be sumped forward again using the sumping rams 106, while the track frame 30 remains stationary and roof bolting continues.

This cycle is repeated until the full one meter advance has been cut, by which time the roof bolting operations should be completed. The track frame 30 would then be trammed forward, while the cutting head 21 and conveyor 28, 28*a* remain in position until the sumping rams 106 are again in the fully retracted position.

Cutting of a turn would be achieved by using the sideways cutting action of the drum 24 on that side. By using a combination of advancing the cutting head with sumping rams 106, slewing the main frame on tracks 30*a*, and with the ability to cut past the end of the face conveyor 28*a*, the full turn would be negotiated. However, at times, it may be necessary to stop cutting operations while bolting is carried out.

It has been calculated, that even without retractable sections on the face conveyor 28*a*, a turn could be negotiated with an inside radius of about 4.5 m.

If ventilation is a problem, an auxiliary blower system may be used with the fan sited in the intake airway. The freshest air available would then be delivered to the face without picking up any dust or methane make from the roadside ribs.

However, the type of cutting action of the machine, being at a continuous, relatively slow rate, is less onerous for ventilation than the present continuous miners which cut coal (and hence release gas) in short bursts at a high rate.

Though the miner driver and roof bolter operators can be sited relatively remotely from the cutting head area, the bolting assistants will be working close to the head at all times. The conveyor back plate height should be sufficient to make it difficult to fall over into the conveyor. Guarding to increase this height can be provided, with a reasonably open mesh, so that visibility for the miner drive is not obscured. A cowl behind the cutter drums to obstruct any material thrown back by the cutters 24 may also be provided.

With the machine of the present invention the time taken for roof support activity is significantly reduced, if not eliminated, Thus, for a 6 hour working shift with a cutting rate of 3.5 tonnes/min for 4 hours, the total production would be 840 tonnes/shift (say 830 tonnes, allowing 10 tonnes left in the ribs). This represents a marked increase over existing production rates which are typically of the order of 300 to 350 tonnes/shift. Compared to a 350 tonnes/shift for, say, 150 days/year represents an additional annual tonnage of 216,000 tonnes.

In addition, because the roadway mined would be narrower than is usually possible with existing continuous miners, and would be a fixed width, a greater proportion of the tonnage produced would represent distance advanced. (For example, for a 5 m wide roadway, each 17.5 tonnes in a 2.5 m seam represents an advance of 1 m; for a 5.5 m roadway, 19.25 tonnes are required for 1 m advance.) The main objective of development is usually to open up blocks for the economic process of pillar extraction, whether by longwall or some other method. A total of 840 tonnes at 17.5 tonnes/m represents an advance/shift of 48 m; a total of 350 tonnes at 19.25 tonnes/m represents an advance/shift of only 18.2 m.

Thus, the machine of the present invention provides a marked improvement in all aspects of the mining operation. The potential financial gains from the increased productivity alone are great, apart from the increase in development rate which, at present, is a major factor in preventing longwall systems from reaching their full potential.

Apart from the production benefits noted above there are a number of other benefits inherent in the machine which are obtained:

(a) Because the machine cuts a narrow roadway with straight ribs, at a relatively slow and gentle rate, with supports set close to the face in a regular pattern, the roadway will be (and is likely to remain) far more stable than roadways mined with existing equipment in the same conditions. This will lead to a reduced likelihood of accidents from falls of material, reduced roadway maintenance costs and possibly reduced initial support costs. In some cases it may be possible to eliminate timber supports altogether.

(b) The added roadway stability will enhance the performance of pillar extraction equipment, whichever method is used.

(c) In mines with weak floors the damage caused by continuous miners moving from side to side in the face area will be eliminated.

We claim:

1. A continuous mining machine, comprising a unitary main frame mounted on tracks for mobility, said main frame having a forward end and a rear end, a cutter head mounted on a sub-frame, means connecting said sub-frame to the forward end of said main frame, said connecting means including means for moving said sub-frame toward and away from the front end of the said main frame, a trailing conveyor carried by said main frame and extending rearwardly beyond the rear end of said main frame, leading conveyor means carried by said sub-frame to collect mined material and convey it to said trailing conveyor, and a plurality of roof bolters each pivotally supported on said main frame adjacent the front thereof such as to be tiltable to allow each bolter to apply roof bolts at spaced apart positions transversely of the direction of movement of the machine, wherein, as said sub-frame is moved away from the front of said main frame and the cutter head mounted thereon operates to cut material to be mined, said roof bolters are simultaneously operated to perform roof bolting operations close to the face of the mine.

2. A continuous mining machine as claimed in claim 1, wherein said sub-frame is adapted to move toward and away from said main frame by rams positioned between said sub-frame and said main frame.

3. A continuous mining machine is claimed in claim 2, wherein said rams are pivotably coupled to said sub-frame and said main frame.

4. A continuous mining machine as claimed in claim 1, wherein said sub-frame is slidably mounted on said main frame via a pivotable joint and means are provided to tilt said sub-frame about said pivot to raise the cutter head supported thereon above the ground when necessary.

5. A continuous mining machine as claimed in claim 1, wherein said roof bolting means comprises a plurality of roof bolters pivotably supported on said main frame so as to be tiltable toward the front of said machine.

6. A continuous mining machine as claimed in claim 1, wherein said cutter head is mounted on said sub-frame so as to be traversable laterally of said machine and a first section of said conveyor means also extends laterally of said machine whereby to collect mined material at the laterally extreme positions of said cutter head.

7. A continuous mining machine as in claim 1 wherein said leading conveyor means includes a zipper conveyor mounted on said sub-frame.

8. A continuous mining machine as in claim 1 wherein said trailing conveyor means is a slew conveyor.

9. A continuous mining machine as claimed in claim 8, wherein said slew conveyor is pivotly supported on said main frame such as to be tiltable upwardly or downwardly with respect thereto.

* * * * *